United States Patent [19]

Cobb et al.

[11] 3,990,595

[45] Nov. 9, 1976

[54] MOUNTING ARRANGEMENT FOR IMPACT ROCK BREAKER

[75] Inventors: Delwin E. Cobb, Peoria; Gerald P. Simmons, Washington; Orrin A. Stemler, East Peoria, all of Ill.

[73] Assignee: Caterpillar Tractor Co., Peoria, Ill.

[22] Filed: Oct. 28, 1975

[21] Appl. No.: 626,385

[52] U.S. Cl. ..... 214/145 R; 173/46; 299/67

[51] Int. Cl.[2] ..... E02F 3/38

[58] Field of Search ..... 214/145 R, 145 A, 620, 214/138 R; 299/67; 173/46; 37/117.5

[56] References Cited

UNITED STATES PATENTS

| | | | |
|---|---|---|---|
| 1,067,375 | 7/1913 | Proctor | 299/67 |
| 2,969,844 | 1/1961 | Hamrick | 214/138 R |
| 3,233,687 | 2/1966 | Grimes | 173/46 |
| 3,779,408 | 12/1973 | Ivie | 37/117.5 |

*Primary Examiner*—Robert J. Spar
*Assistant Examiner*—Ross Weaver
*Attorney, Agent, or Firm*—James R. Bell

[57] ABSTRACT

An impact rock breaker includes detachable mounting means and latching means operative for mounting the rock breaker on the stick of a backhoe or excavator adjacent the bucket such that the rock breaker can be pivoted to a nonoperative position latched to the stick out of the way of the bucket to permit normal operation of the bucket and an operative position pivoted to and latched to the bucket for movement with the bucket for normal operation of the rock breaker.

15 Claims, 5 Drawing Figures

MOUNTING ARRANGEMENT FOR IMPACT ROCK BREAKER

REFERENCE TO RELATED APPLICATIONS

The present application relates to common subject matter with application Ser. No. 526,280, now U.S. Pat. No. 3,915,501 of common assignment herewith.

BACKGROUND OF THE INVENTION

The present invention relates to excavating apparatus and particularly to an impact rock-breaking apparatus with mounting means for mounting on an excavator or backhoe.

When undertaking excavating work such as with backhoes or excavators, it is frequently necessary to carry out distinct phases of the operation requiring different tools. For example, when excavating with a backhoe or excavator one may encounter hard rock formations or concrete which requires breaking up before it can be removed. Such situations may require that a jackhammer or similar tool be moved to break up the rock or concrete in order that it may be removed from the excavation. Frequently, however, the rock or concrete cannot be reached by or is inaccessible to a jackhammer.

Rock-breaking tools for mounting on the end of the boom or stick of an excavator or backhoe are known. Such tools, however, generally require that the bucket be removed in order that the rock-breaking tools can be attached to the stick of the excavator. This approach is extremely time-consuming and expensive.

Another approach to this problem has been providing the excavator bucket with vibrating teeth for breaking the rock or concrete. The major problem with this approach is that such apparatus is generally incapable of developing sufficient force to efficiently break concrete and other hard rock materials.

Another approach to this problem is such as disclosed in British Specification No. 1,172,537 published Dec. 3, 1969. That specification discloses an arrangement having two separate booms and an arrangement wherein a bucket and a rock-breaking device are both mounted on the same arm of an excavator. The bucket is slidably mounted on the arm to swing or slide into and out of operative position. The problem with the arrangement is that it requires complicated and expensive apparatus and the bucket suffers in strength and durability.

One solution to the above problem is set forth in co-pending U.S. application 526,280 filed Nov. 11, 1974. The present application is directed to improvements thereof.

SUMMARY AND OBJECTS OF THE INVENTION

It is, therefore, a primary object of the present invention to provide a machine capable of performing multiple types of operations with a minimal amount of time required switching from one operation to another.

Another object of the present invention is to provide a material-fracturing apparatus with improved mounting means for mounting the apparatus on the stick of an excavator without interfering with the use of the bucket of the excavator.

A further object of the present invention is to provide a rock-breaking apparatus that is attachable to the stick of an excavator or backhoe and latchable into selected positions to permit normal operation of both the rock-breaking apparatus and the bucket.

In accordance with the primary aspect of the present invention, a rock-breaking apparatus is pivotally secured at a common pivot point with the bucket of an excavator and is swingable and latchable into an operating position and latchable into a nonoperating position to permit normal operation of the bucket of the machine and includes common actuating means for simultaneously unlatching the apparatus from one position when latching it into the other position.

BRIEF DESCRIPTION OF THE DRAWINGS

The above and other objects and advantages of the present invention will become apparent from the following description when read in conjunction with the accompanying drawings wherein.

DETAILED DESCRIPTION OF THE PREFERRED EMBODIMENT

Figures 1, 5:
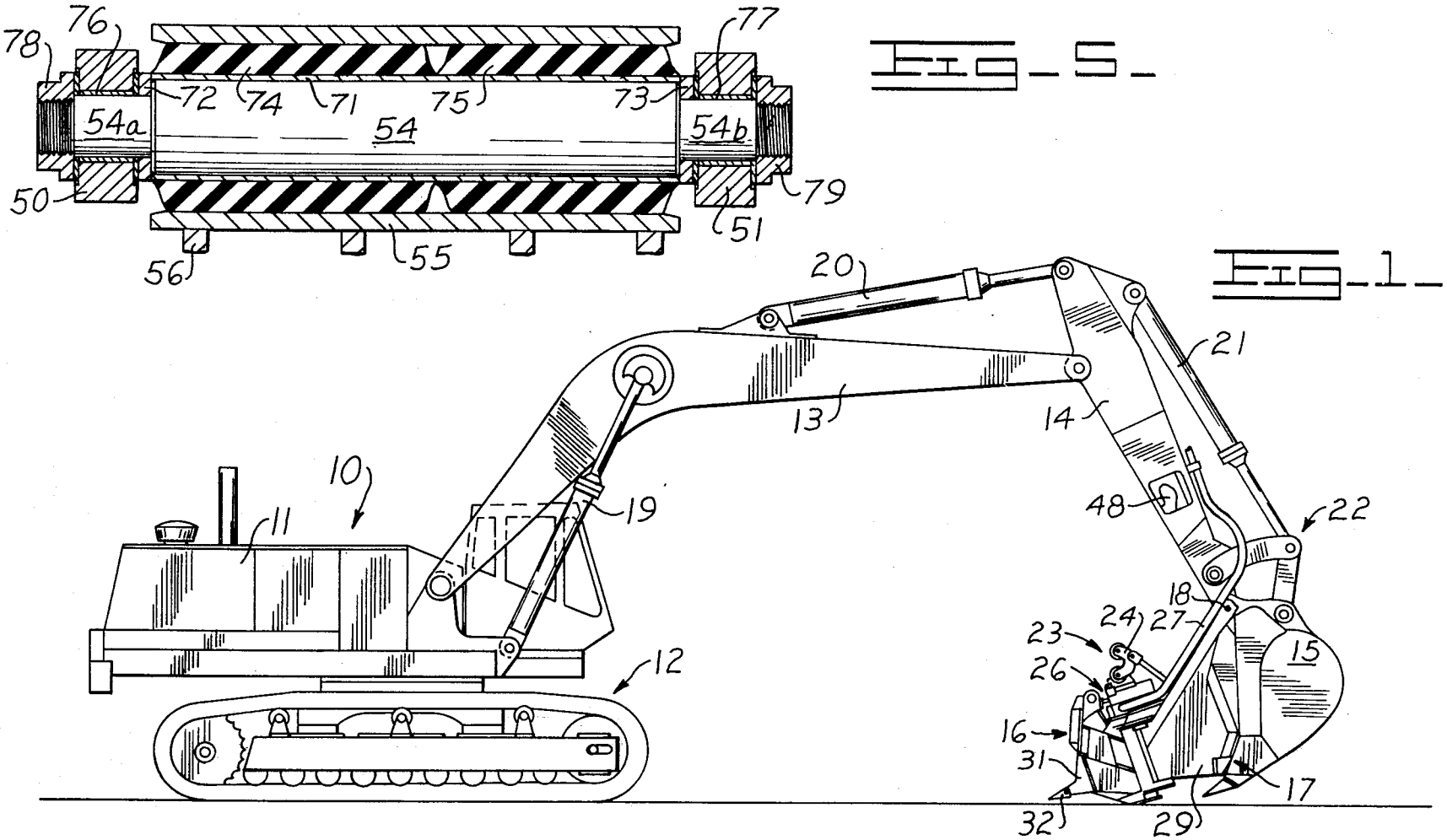
FIG. 1 is an elevational view of an excavator machine embodying an apparatus of the present invention.

Referring now to the drawings, particularly to FIG. 1, there is illustrated a hydraulic excavator designated generally by the numeral 10 which includes an upper structure 11 rotatably mounted on a lower structure including movable endless track assemblies 12. A boom 13 is pivotally mounted at its inner end in the usual manner to the upper structure 11 and pivotally supports a stick or an arm 14 at its outer end. A bucket 15 is pivotally supported on the outer end of the stick 14.

A material-fracturing or rock-breaking apparatus of the impact type is generally designated by the numeral 16, is pivotally mounted about the same pivot point 18 as that of the bucket 15 and pivots about that point to first and second latched positions. Suitable first latching means indicated generally at 17 is provided for latching the apparatus in a first position to the bucket 15, as shown (FIG. 1), for movement therewith to the operative position.

The boom 13 is controlled in the usual manner by means of a pair of cylinders 19, and the stick 14 is similarly controlled by means of a hydraulic cylinder 20. A hydraulic cylinder 21 is pivotally connected at its upper end to the stick 14 and at its lower end to wrist linkage 22 which in turn is connected to the bucket 15 for movement of the bucket about its pivot point 18.

Figure 2:
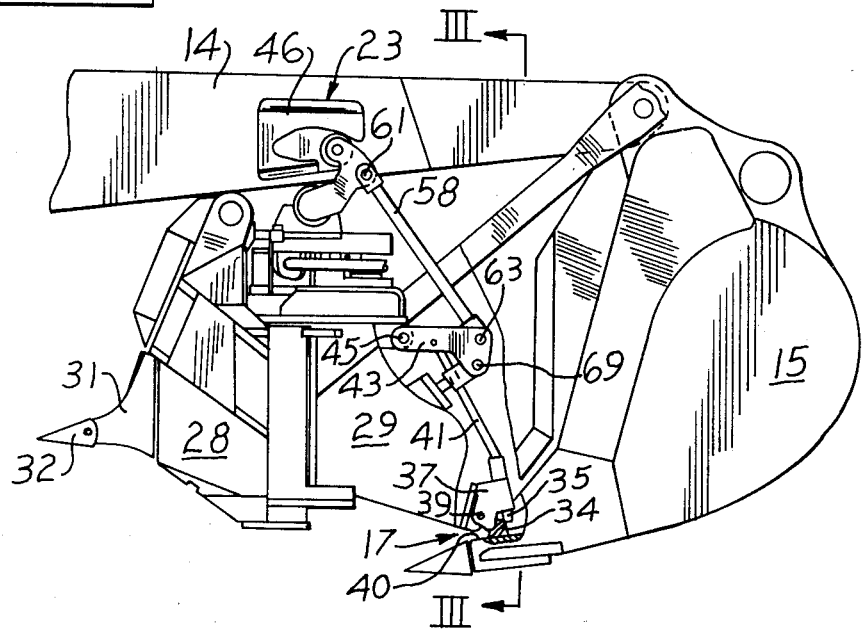
FIG. 2 is a side elevational view of the apparatus of the present invention with portions broken away to reveal details.

The apparatus includes second latch means indicated generally at 23, for latching the apparatus to the stick 14 for retaining or holding the apparatus in a position against the stick 14 to permit normal operation of the bucket 15. The first latch means 17 holds the apparatus latched to bucket 15 as shown in FIG. 1 for movement therewith. When the apparatus is latched into position against the stick, as shown in FIG. 2, the bucket 15 is free to function in the normal manner. Latching the mechanism in a position against the stick, as shown in FIG. 2, is accomplished by curling the bucket 15 upwards against the stick until the latch mechanism 23 engages latch means on the stick to be described at which time the latch mechanism is actuated simultaneously releasing latch 17 and engaging latch means 23, securing the material-fracturing apparatus to the stick in the position as shown in FIG. 2. The latch mechanism 17 is simultaneously unlocked or unlatched from bucket 15, permitting the bucket to swing away for use in the normal manner.

The material-fracturing device preferably includes a mechanism of the type shown in either one of U.S. Pat. No. 3,868,148 entitled Eccentric Ring Impacting Mechanism issued Feb. 25, 1975, or U.S. application No. 533,192 entitled Impact Material Fracturing Device for Excavators and the Like, filed Dec. 16, 1974 of common assignment herewith, which are rotary impact devices and are preferably driven by rotary hydraulic motors.

In the present arrangement, the hydraulic motor may be constructed as a subassembly generally designated by the numeral 26 and may be readily detachable from the main housing and frame assembly of the fracturing apparatus as in the aforementioned application. With such an arrangement, the hydraulic motor subassembly 26 can be left latched to the stick permitting the fracturing apparatus housing and support frame to be readily removed. This would leave the hydraulic lines 27 for supplying fluid to the motor 26 intact without requiring them to be uncoupled therefrom. This arrangement would permit ready detachment of the fracturing apparatus without the possibility of contamination of the hydraulic oil supply. Such contamination would be possible if the hydraulic lines were required to be removed and capped upon removal of the assembly. The present apparatus, however, is not concerned with that problem.

Turning now to FIG. 2 wherein there is illustrated in an enlarged elevational view, a housing 28 which encloses and mounts the drive shaft, flywheels and other related internal components, is rotatably supported by means of a main support member 29 and is adjustable with respect thereto by means of a pair of hydraulic cylinders not shown. The main support member 29 is pivotally supported by a pair of support arms or brackets 30 to the stick 14 at pin 18 for pivotal movement about this pin. The internal mechanism of the impact material-fracturing apparatus including a fracturing shank 31 and a fracturing tip 32 are preferably similar to those disclosed in U.S. Pat. No. 3,868,148 pointed out above.

Figure 3:
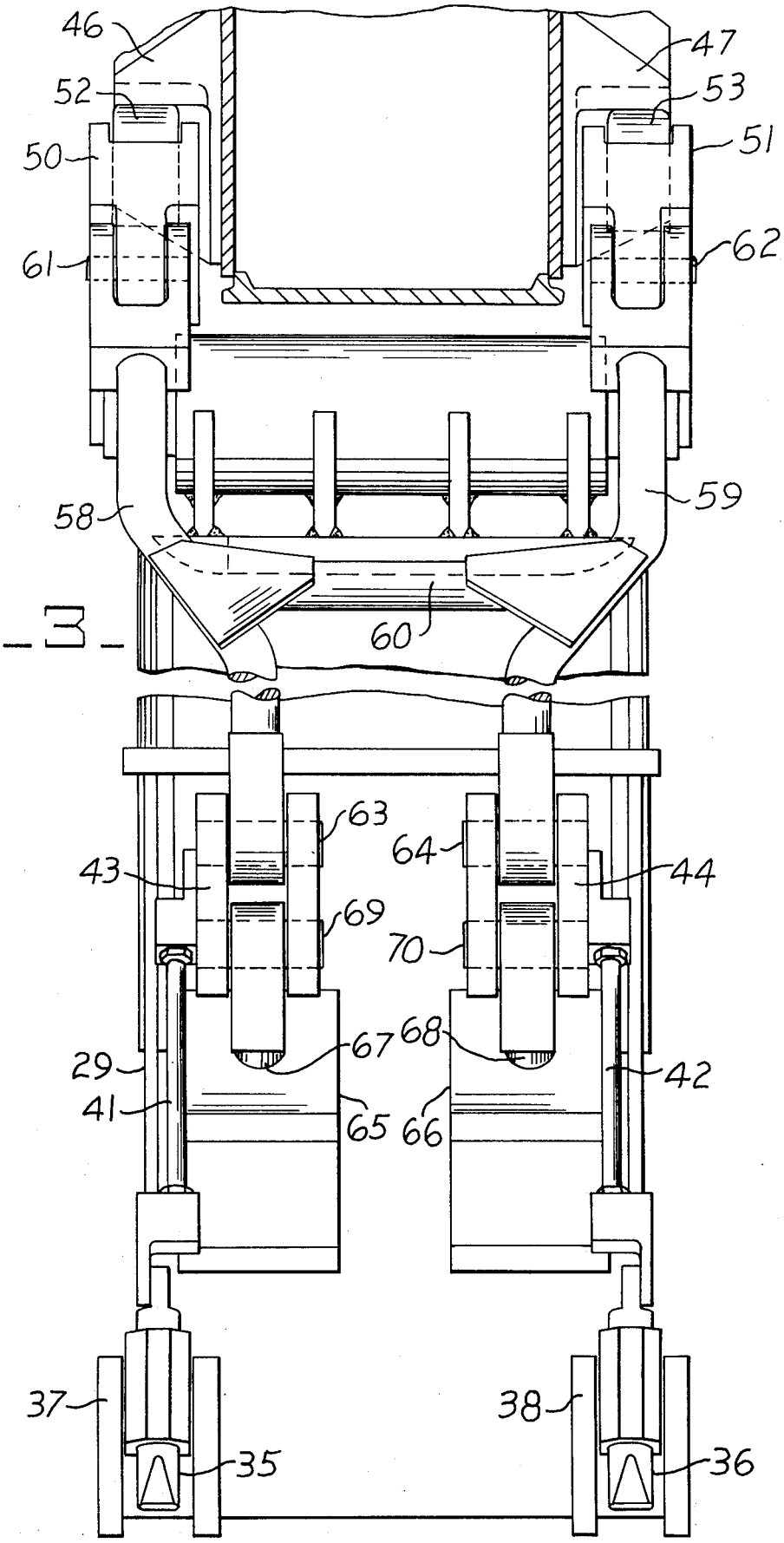
FIG. 3 is a view taken generally along lines III-III of FIG. 2.

With reference now to FIGS. 2 and 3, the latching mechanism 17 for latching or locking the impact apparatus to the bucket comprises one or more wedge-shaped keeper or latch members 34 fixed to the inside of the bucket 15 just behind the forward edge or cutting edge thereof and extending upward therefrom. The keeper or latch member 34 may comprise one member extending all the way across the bucket or may be two separate members at each side of the bucket for engagement by a pair of latch pins 35 and 36 which are suitably mounted or supported by brackets 37 and 38 for longitudinal movement toward and away from the member 34. The brackets 37 and 38 are suitably mounted on support structure 29 such as by a pivot pin 39 and includes an abutting surface 40 for engaging one side of the wedge member 34 opposite the pin 35. This latches the support structure 29 securely to the bucket 15.

The latch pins 35 and 36 are connected in a suitable manner to a pair of actuating rods 41 and 42 which in turn are pivotally connected at their upper ends to a pair of levers or bellcranks 43 and 44. The bellcranks 43 and 44 are suitably connected such as by a pin 45 to the support structure 29 for pivotal movement thereon.

The upper latch means 23 includes a pair of latch brackets 46 and 47 one connected or secured to each side of the stick 14. Each of these brackets are shaped to define a slot 48 having an entry opening and having a lower wall shaped to have a slight depression to define a detent 49. A pair of substantially L-shaped arms 50 and 51 are pivotally connected in a suitable manner to the support structure 29 and each include a roller 52 and 53 on its opposite end for engagement with the lower wall or detent 49 of the respective brackets 46 and 47.

The L-shaped arms 50 and 51 are pivotally mounted such as by means of a shaft 54 mounted in a cylindrical bracket member 55 forming part of a vibration isolation bracket having a base member 56 which is attached such as by bolts 57 to the housing or support structure 29.

Figure 4:
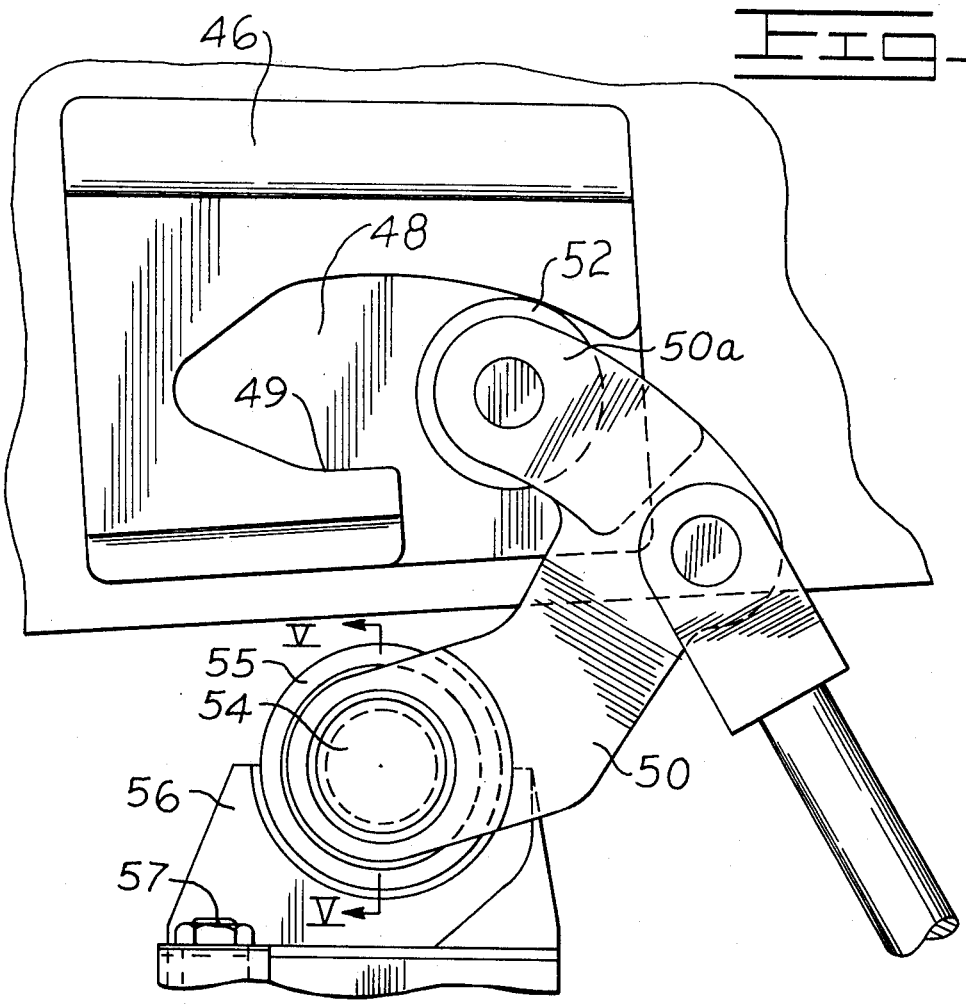
FIG. 4 is an enlarged view of a portion of the latch apparatus of FIG. 2; and, FIG. 5 is a sectional view taken generally along lines V—V of FIG. 4.

The arm 50, as best seen in FIG. 4, includes an outwardly extending bifurcated arm portion 50A which supports the roller 52 between the bifurcated portion. This extends the roller 52 outward to extend into the slot 48 for engagement with the detent like surface 49 formed within the bracket 46. This presents the roller 52 substantially directly above the pivot axis of shaft 54 which mounts the arm 50 such that downward force by the weight of the apparatus supported by the support structure 29 would tend to retain the assembly within the detent portion 49 of the slot 48. The other arm 51 is identical in structure and cooperates in a similar manner with the bracket 47.

A yoke-like linkage structure comprising a pair of support links 58 and 59 connected together by a cross member 60 are pinned at their upper ends 61 and 62 to the respective L-shaped arms 50 and 51. This link yoke assembly is also pivotally connected at its lower end at 63 and 64 to the lever or bellcrank 43.

It is thus seen that both of the latch means 17 and 23 are connected together to a common bellcrank or lever arm 43 and 44. The latch mechanisms are operated together simultaneously by means of suitable actuating means such as a pair of hydraulic cylinders 65 and 66 preferably of the double acting type having extensible rods 67 and 68 pivotally connected by suitable pin means at 69 and 70 to the bellcrank 43 and 44. With this connection, actuation of the cylinders 65 and 66 actuates both of the latch means 17 and 23 simultaneously.

Suitable hydraulic means including a suitable circuit, not shown, may be provided for actuation of the respective cylinders 65 and 66. Thus, any suitable circuit may be provided for introducing fluid to the double acting motors 65 and 66 for activating the selected latch means. Thus, when the rock breaking apparatus is in the position, as shown in FIG. 2, either one of the latch means 17 or 23 may be activated to either one of the bucket 15 or the stick 14. With the assembly latched to the bucket 15, it may be maneuvered into positions to utilize the rock breaking apparatus to break rock concrete and the like.

When it is desired to utilize the bucket of the machine, the assembly is simply moved to the position, as shown in FIG. 2, and the upper latch means 23 is activated to latch the apparatus 16 to the stick 14 with the latch 17 simultaneously therewith releasing the lower latch means to thereby permit the bucket 15 to pivot away from the assembly. Thus, the rock breaking apparatus is secured to the stick 14 with the bucket 15 free to be used in the usual manner.

As best seen in FIG. 4, the vibration isolation mounting bracket comprises a shaft 54 which is mounted within the bore of cylindrical bracket member 55 by means of a sleeve. The sleeve comprises an inner metal sleeve 71 fitted to the central portion of shaft 54 and including a pair of end thrust rings 72 and 73 engaging the shoulders of shaft 54 to prevent axial movement. A pair of flexible or resilient outer sleeves 74 and 75 are fitted within the bore of the tubular bracket member 55 and to the outer surface of sleeve 71.

The arms 50 and 51 are each journaled by bearing means 76 and 77 to reduce journal portions 54*a* and 54*b* of shaft 54. The arms 50 and 51 are retained in place by suitable nuts 78 and 79 threadably secured to the ends of the journals 54*a* and 54*b*.

This isolation bracket is effective to isolate a large amount of shock and vibration in the stick 14 from the ripper apparatus 16 when the ripper is second to the stick. These vibrations result from working the bracket in rough and hard materials, such as dragging the bracket across uneven or rocky ground.

While the present invention has been illustrated and described by means of a singled preferred embodiment, it is to be understood that numerous changes may be made therein without departing from the spirit and scope of the invention as defined in the appended claims.

What is claimed is:

1. In a material-fracturing apparatus for mounting adjacent the bucket of an excavator having a boom, a stick and a bucket mounted on one end of the stick, and comprising a housing having a fracturing shank supported by and extending therefrom and means for applying impact blows to said shank for breaking hardened materials, support means including bracket means extending from said housing for pivotal connection to the stick of an excavator adjacent the bucket of said excavator, the combination of:

first latch means for latching said housing means in a first latched position to said bucket for manipulation of said fracturing device into operative position by manipulation of said bucket;

second latch means for latching said housing in a second latched position to said stick out of the way of said bucket to permit free operation of said bucket; and, common actuating means for simultaneously moving one of said first and second latch means into latching condition and the other of said first and second latch means out of latching condition.

2. The material-fracturing apparatus of claim 1 wherein said bracket means pivotally connects to said stick at the pivotal connection of said bucket thereto so that said housing and said bucket pivots about the same point on said stick and said housing pivots about said point to either one of said first and second latched positions.

3. The material-fracturing apparatus of claim 1 wherein said bracket means extends from said housing in a direction opposite that of said fracturing shank.

4. The material-fracturing apparatus of claim 1 wherein:

said first latch means comprises at least one fixed latch member attached to said bucket, and at least one movable pin mounted on said support means for movement into and out of engagement with said fixed latch member;

said second latch means comprises at least one slot means carried by said stick and at least one L-shaped arm mounted on said support means and pivotal into engagement with said slot; and, said common actuating means comprises at least one linear double acting hydraulic actuator, and means for connecting said actuator to said movable pin and to said L-shaped arm for simultaneous movement thereof.

5. The material-fracturing apparatus of claim 4 wherein said second latch means comprises:

a pair of said slot means, said slot means comprises a pair of block members with one of said block members secured to each side of said stick and an open ended slot formed in each of said block members, a pair of said L-shaped arms pivotally secured at one end to said support means for engagement at the other end with said open ended slots.

6. The material-fracturing apparatus of claim 5 wherein said common actuating means comprises:

a pair of said hydraulic actuators, a pair of bellcranks pivotally mounted on said support means and each connected to one of said hydraulic actuators;

first link means connecting said bellcranks to said first latch means; and, second link means connecting said pair of bellcranks to said L-shaped arms.

7. The material-fracturing apparatus of claim 6 wherein each of said slots is shaped to define detent means; and each of said L-shaped arms include a roller mounted thereon for engagement with said detent means.

8. Material-fracturing apparatus for mounting on a support arm adjacent an excavating bucket, said apparatus comprising:

a support arm having an excavating bucket pivotally connected to one end thereof;

a housing having a fracturing shank supported by and extending therefrom and means for applying impact blows to said shank for breaking hardened materials;

bracket means extending from said housing for pivotal connection to the end of said support arm adjacent and forward of said bucket;

first latch means for latching said housing means to said bucket for manipulation of said fracturing apparatus into operative position by manipulation of said bucket;

second latch means for latching said housing to said stick to permit free operation of said bucket; and, common actuating means for moving one of said latching means into latching condition and simultaneously moving the other of said latching means out of latching condition.

9. The material-fracturing apparatus of claim 8 wherein said bracket means pivotally connects to said arm at the pivotal connection of said bucket thereto so that said housing and said bucket pivots about the same point on said stick.

10. The material-fracturing apparatus of claim 9 wherein:

said second latch means comprises slot defining means mounted on each side of said arm and defining an open ended slot on each side of said arm;

arm means including a pair of L-shaped arms mounted on said bracket means for extending into the open end of said slots; and, said common actuating means includes hydraulic actuator means mounted on said bracket means and link means connecting said actuator means to said L-shaped arms.

11. The material-fracturing apparatus of claim 10 wherein:

each of said slots include detent means; and, each of said arms include a roller mounted on one end thereof for engagement with said detent means.

12. The material-fracturing apparatus of claim 10 wherein:

said link means comprises a pair of bellcranks pivotally mounted on said bracket means and connected to said hydraulic actuator means; and, a substantially H-shaped link member connecting said bellcranks to said L-shaped arms.

13. The material fracturing apparatus of claim 4 wherein:

said L-shaped arm of said second latch means is rotatably mounted on said support means by vibration isolating bracket means.

14. The material fracturing apparatus of claim 13 wherein:

said vibration isolating bracket means comprises a tubular member secured to said support means;

resilient bushing means disposed in said tubular member; and, shaft means mounted within said resilient bushing means and rotatably mounting said L-shaped arm.

15. The material fracturing apparatus of claim 10 including vibration isolating means for mounting said L-shaped arms to said bracket means;

said vibration isolating means comprising a tubular member secured to said bracket means;

resilient sleeve means disposed in said tubular member; and, a shaft mounted in said resilient sleeve means and rotatably supporting said L-shaped arms on the ends thereof.

* * * * *

UNITED STATES PATENT AND TRADEMARK OFFICE

CERTIFICATE OF CORRECTION

PATENT NO. : 3,990,595

DATED : November 9, 1976

INVENTOR(S) : DELWIN E. COBB et al

It is certified that error appears in the above-identified patent and that said Letters Patent are hereby corrected as shown below:

Col. 5, line 24, "second" should be --secured--:
line 25, "bracket" should be --bucket--:
line 27, "bracket" should be --bucket--.

Col. 6, Claim 4, lines 7, 8 and 13, delete "L-shaped".

Claim 5, line 22, delete "L-shaped".

Claim 6, line 33, delete "L-shaped".

Claim 7, line 36, delete "L-shaped".

Col. 7, Claim 10, lines 4 and 10, delete "L-shaped".

Claim 12, line 24, delete "L-shaped".

Col. 8, Claim 13, line 3, delete "L-shaped".

Claim 14, line 13, delete "L-shaped".

Claim 15, lines 16 and 22, delete "L-shaped".

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*